US007673908B2

(12) United States Patent
Liptan

(10) Patent No.: US 7,673,908 B2
(45) Date of Patent: Mar. 9, 2010

(54) FOLDABLE CLIPBOARD

(76) Inventor: Ginevra Liptan, 6526 NE. Rodney Ave., Portland, OR (US) 97211

( * ) Notice: Subject to any disclaimer, the term of this patent is extended or adjusted under 35 U.S.C. 154(b) by 426 days.

(21) Appl. No.: 11/701,031

(22) Filed: Jan. 31, 2007

(65) Prior Publication Data

US 2007/0187565 A1 Aug. 16, 2007

Related U.S. Application Data

(60) Provisional application No. 60/765,477, filed on Feb. 2, 2006.

(51) Int. Cl.
*B42D 5/00* (2006.01)

(52) U.S. Cl. ..... 281/45

(58) Field of Classification Search ..... 248/442.2, 248/444.1, 452, 460, 462; 40/658; 281/44–50, 281/51, 15.1, 28, 29, 33; 402/4, 70, 73
See application file for complete search history.

(56) References Cited

U.S. PATENT DOCUMENTS 3,791,314 A * 2/1974 Berretta ..... 108/43
4,019,823 A * 4/1977 Kleinert et al. ..... 402/75
4,583,562 A * 4/1986 Stewart ..... 132/212
4,828,502 A * 5/1989 Leahy ..... 434/416
6,662,733 B1 * 12/2003 Scott ..... 108/43
2001/0000901 A1 * 5/2001 Kambouris et al. ..... 220/212
2003/0106979 A1 * 6/2003 Richardson ..... 248/460
2004/0217677 A1 * 11/2004 Durand et al. ..... 312/108
2004/0234939 A1 * 11/2004 Smith et al. ..... 434/408

OTHER PUBLICATIONS www.dictionary.com- definition of crease.*
http://www.cfipilot.com/ASA-Folding-Lapboard-p/asa-kb-lap.htm (last visited Jan. 31, 2007).
http://www.saunders-usa.com/core/?brand=70 (last visited Jan. 31, 2007).

* cited by examiner

*Primary Examiner*—Dana Ross
*Assistant Examiner*—Matthew G Katcoff
(74) *Attorney, Agent, or Firm*—Alleman Hall McCoy Russell & Tuttle LLP

(57) ABSTRACT

A foldable clipboard. The foldable clipboard includes a pair of support panels that are hinged together. The hinged design allows the clipboard to be conveniently folded for easy transportation and storage. The clipboard also can be unfolded into a substantially flat configuration.

19 Claims, 2 Drawing Sheets

FOLDABLE CLIPBOARD

CROSS REFERENCE TO RELATED APPLICATIONS

This application claims the benefit of U.S. Provisional Application No. 60/765,477, filed Feb. 2, 2006, the entirety of which is incorporated by reference.

BACKGROUND

There are many occupations, hobbies, and other endeavors in which a person moves from one location to the next, and in which the person takes notes at the various locations. Clipboards have been used to facilitate such note-taking, and to otherwise organize papers and assist people perform a plethora of different activities. The inventor herein has recognized that traditional clipboards can be cumbersome to carry due to their relatively large size.

SUMMARY

The present disclosure is directed to a foldable clipboard. The foldable clipboard includes a pair of support panels that are hinged together. The hinged design allows the clipboard to be conveniently folded for easy transportation and storage. The clipboard also can be unfolded into a substantially flat configuration. According to one aspect of the disclosure, a flexible sheet can be used to span across both panels and to provide a smooth writing surface when the clipboard is unfolded. According to another aspect of the disclosure, a clip can be operatively coupled to one of the panels and used to hold papers or other materials in place.

WRITTEN DESCRIPTION

Figure 3:
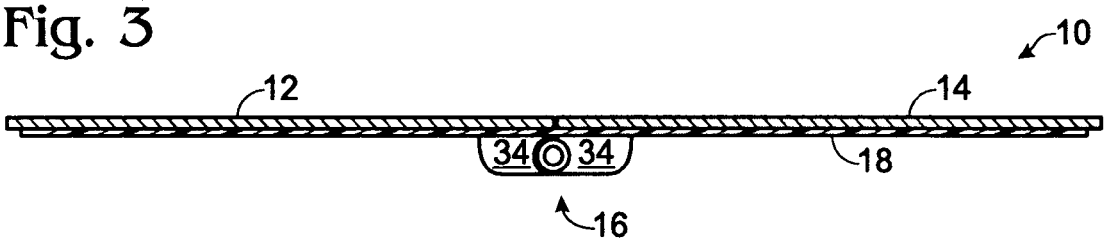
FIG. 3 shows a cross-sectional view of the foldable clipboard of FIG. 1 in a flat configuration.
Figure 4:
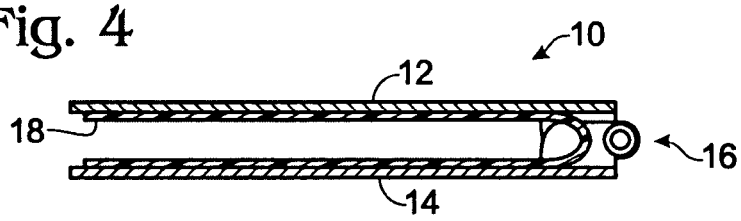
FIG. 4 shows a cross-sectional view of the foldable clipboard of FIG. 1 in a folded configuration.
Figure 5:
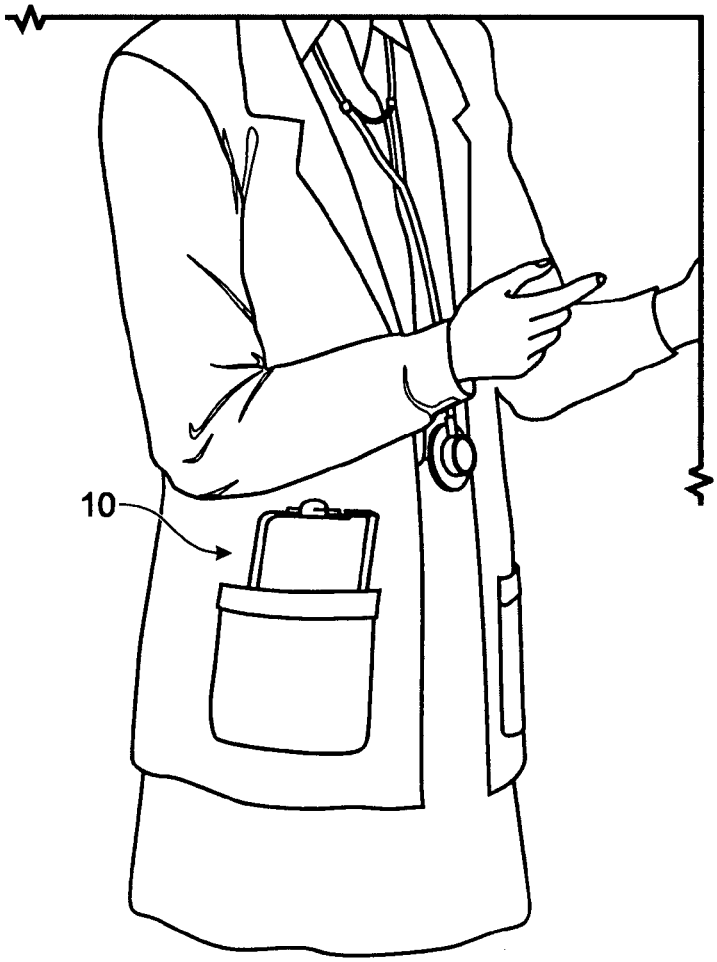
FIG. 5 shows the foldable clipboard of FIG. 1 in a folded configuration and stored in a doctor's white coat.

FIGS. 1-5 show an exemplary foldable clipboard 10 in accordance with an embodiment of the present disclosure. In the illustrated embodiment, clipboard 10 is designed for use by doctors and medical students. Clipboard 10 is of particular use to doctors and medical students because clipboard 10 can be folded to fit in a doctor's white coat, as shown in FIG. 5. However, it should be understood that foldable clipboards can be designed to accommodate the needs of a variety of different people. Clipboard 10 is provided as a nonlimiting example of one such clipboard. Various changes in form and detail can be made without departing from the scope of the present disclosure.

Foldable clipboard 10 includes a left support panel 12 and a right support panel 14. The left and right support panels are moveably connected to one another by a hinge 16. Clipboard 10 also includes a flexible sheet 18 that spans across the left support panel and the right support panel, bridging any gap between the panels. Also, a clip 20 for holding papers in place is connected to the left support panel.

The left and right support panels of clipboard 10 are substantially identically shaped. While this is not required in all embodiments, it can decrease manufacturing costs. Each panel is substantially rectangular with rounded corners. The rounded corners make it easier to slide a folded clipboard into a pocket without snagging. Each panel is approximately 10.8 centimeters wide by 28.6 centimeters tall. This size provides a clipboard that can fully support a letter-sized piece of paper when the clipboard is in its flat configuration, yet allows the clipboard to be stowed in a doctor's white coat when it is in its folded configuration. Of course, clipboards can be sized and shaped differently to accommodate differently sized paper, different storage requirements, and/or any number of other factors without departing from the scope of this disclosure.

The clipboard panels can be made from aluminum, plastic, or another suitable material. Aluminum provides a very strong, light-weight panel that is very durable. Plastic also provides a fairly strong and light-weight panel that is relatively inexpensive to manufacture.

Each panel can be described as having a top edge 24, a bottom edge 26, an exterior edge 28, and an interior edge 30. The edges at least partially define a writing surface 32. The writing surface can be constructed to be substantially rigid and substantially planar, so as to provide a good support for writing.

Figure 2:
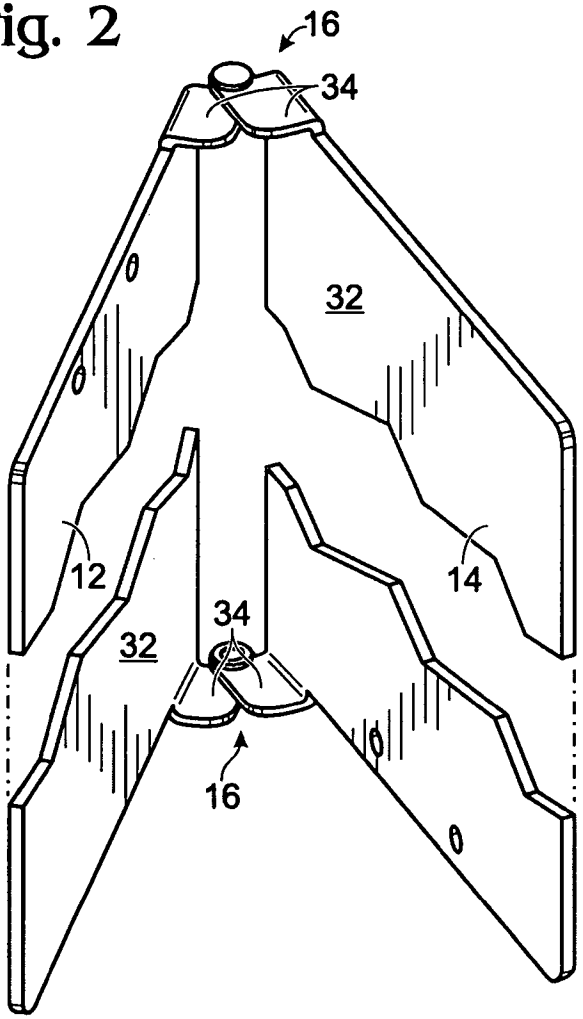
FIG. 2 shows a hinge and panel assembly of the foldable clipboard of FIG. 1.

As best shown in FIG. 2, the right and left panels each include two integrated hinge surfaces 34, one at the top interior edge and one at the bottom interior edge. The hinge surfaces are substantially perpendicular to the writing surface, thus allowing the hinge surface of the left support panel and the hinge surface of the right support panel to move parallel to one another as the clipboard is folded or unfolded. The hinge surfaces from opposing support panels can be pivotably connected to one another by a pin, gasket, bearing assembly, and/or other suitable mechanism.

It should be understood that the illustrated hinge is a nonlimiting example, and that other hinges can be used without departing from the scope of this disclosure. Hinges that do not create a bulge or other obstruction when the clipboard is in the flat configuration are well suited for applications where the clipboard is used as a support for writing and/or drawing. Furthermore, relatively light hinges are well suited for applications where the clipboard is carried. While the illustrated hinges are continuous with the writing surface, this is not required in all embodiments. The hinge mechanism can include one or more separate pieces that are mounted to the panels. Nonlimiting examples of alternative hinges include butt hinges, knife hinges, and piano hinges.

As best shown in FIGS. 3 and 4, the illustrated hinge allows the support panels to pivot approximately 180° relative to one another. In other words, when in the flat configuration, the left panel is pivoted 180° relative to the right panel, and when in the folded configuration the left panel is generally 0°±20° relative the right panel.

The hinge can be designed so that the interior edge of the left panel aligns substantially adjacent to the interior edge of the right panel when the clipboard is in its flat configuration, although this is not required in all embodiments. In this way, it is easy to put the clipboard into a substantially flat configuration because the abutting support panels prevent the clipboard from unfolding past 180°. Of course, in other embodiments, the hinge can be designed to provide a different range of motion, including unfolding past 180°, and even unfolding to 360° (i.e., folding back on itself).

When the interior edges are aligned substantially adjacent to one another, the supports collectively form a substantially continuous surface. In this configuration, the unfolded clipboard behaves much the same as a traditional clipboard. However, even small misalignments or gaps can negatively affect the ability of the foldable clipboard to serve as an excellent writing surface.

Flexible sheet 18 can help smooth the transition from the left support panel to the right support panel. In fact, the flexible sheet can substantially erase any perceivable gap and/or minor misalignment between the panels. When used, the flexible sheet can be attached to the left support panel and the right support panel so that when the clipboard is folded and unfolded, the flexible sheet automatically moves with the panels.

As a nonlimiting example, the flexible sheet can be adhered to at least a portion of the first support panel and to at least a portion of the second support panel. However, depending on hinge design, if the flexible sheet is adhered to the support panels near their interior edges, the flexible sheet can restrict folding of the clipboard. To accommodate hinge designs in which a gap forms between the interior edges of the support panels, the flexible sheet can be left unadhered proximate the interior edges of the support panels. As a nonlimiting example, the flexible sheet may not be adhered to the left support panel within one inch of the interior edge of the left support panel nor to the right support panel within one inch of the interior edge of the right support panel. Of course, more or less of the flexible sheet can be left unadhered depending on the gap requirements of the selected hinge.

When a portion of the flexible sheet is left unadhered, the flexible sheet is allowed to form a relatively gentle curve when the clipboard is folded. This can help prevent papers held by the clipboard from creasing when the clipboard is folded.

The flexible sheet can be made from a variety of different materials, including, but not limited to, 0.010" rigid vinyl. Of course, thicker or thinner flexible sheets can be used, as can sheets made from other materials, such as polycarbonate or polyester.

In addition to improving the writing surface of the folding clipboard, the flexible sheet also provides an easy way to customize the foldable clipboard for different uses. As an example, in order to customize the clipboard for a particular group of people, the flexible sheet can be marked with information that is useful to that group of people. If the clipboard is designed for doctors or medical students, the flexible sheet can include reference information used by doctors and medical students when charting patients. If the clipboard is designed for a building inspector, the flexible sheet can include building code and regulation information. If the clipboard is used by a coach, the flexible sheet can include personnel information and an index of plays. As can be seen, the flexible sheet allows the clipboard to be customized for virtually any task. The clipboard can be further customized by applying information to the back-sides of the support panels.

Figure 1:
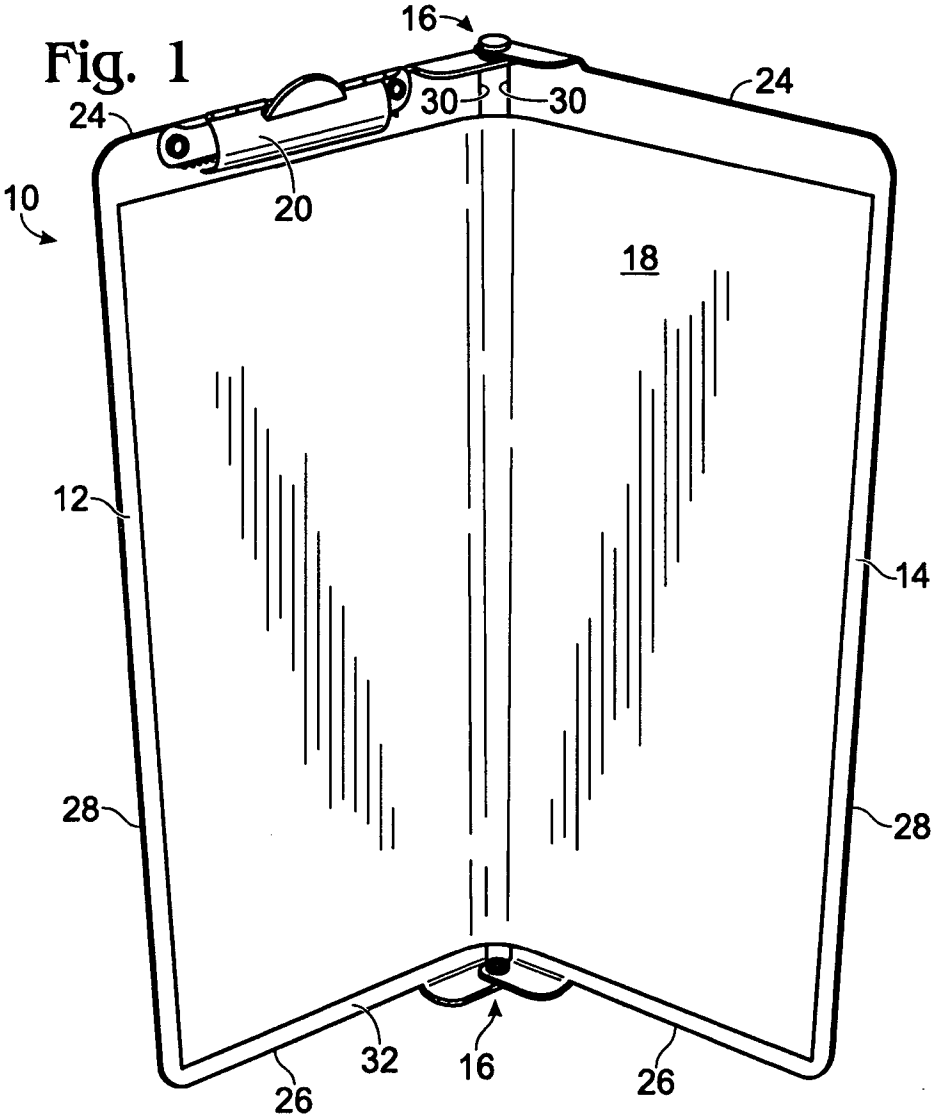
FIG. 1 shows a foldable clipboard in accordance with the present disclosure.

As shown in FIG. 1, a clip 20 is operatively coupled to left support panel 12. In the illustrated embodiment, clip 20 is a spring clip sized to hold up to 50 or more pieces of paper to the clipboard. Unlike traditional clipboards, clip 20 is not positioned in the middle of the clipboard, but is rather offset, thus allowing the clipboard to fold down the middle.

While clip 20 is shown operatively coupled to the left support panel, it can just as easily be coupled to the right support panel or another portion of the clipboard. In fact, in some embodiments, two clips may be used, one coupled to each support panel. Furthermore, other types of clips, such as a low profile wire clip or a magnetic clip can be used.

In many embodiments, the clip also serves as a spacer that determines how far the clipboard can be folded. Taller clips may prevent the clipboard from fully folding to 0°, while shorter clips may allow the clipboard to fold past 0°.

While the above described clipboard folds lengthwise along its longitudinal axis to form a folded rectangle with a length dimension substantially greater than a width dimension, it should be understood that other folding arrangements can be implemented. For example, instead of left and right support panels, the clipboard can be configured with top and bottom support panels that fold together along the clipboard's latitudinal axis. In this way, the folded clipboard has more equivalently sized length and width dimensions, which can be advantageous for different storage considerations. Furthermore, while the above described clipboard is sized to accommodate 8.5"×11" paper, the above described principles can easily be adapted to accommodate differently sized paper.

No matter what size and shape is ultimately chosen, folding clipboards according to the present disclosure provide a smooth writing surface when in the flat configuration, while at the same time providing improved portability and storability when in the folded configuration. Furthermore, when in the folded configuration, the clipboard naturally hides the papers it is holding, thus helping maintain confidentiality when that is desired.

The following claims particularly point out certain combinations and subcombinations regarded as novel and nonobvious clipboards. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A foldable clipboard, comprising:

a first, substantially-rigid, support panel;

a second, substantially-rigid, support panel;

a hinge pivotally connecting the first support panel to the second support panel such that the first support panel and the second support panel are moveable between a flat configuration and a folded configuration, the first support panel and the second support panel cooperating to form a substantially continuous and substantially planar writing-support surface when in the flat configuration, the hinge having an axis of rotation spaced a clip-accommodating distance in front of the first support panel and the second support panel when the first support panel and the second support panel are in the flat configuration; and a clip connected to the first support panel.

2. The foldable clipboard of claim 1, further comprising a flexible sheet attached to the first support panel and the second support panel, the flexible sheet configured to provide a substantially smooth writing surface when the first support panel and the second support panel are in the flat configuration.

3. A foldable clipboard, comprising:

a first, substantially-rigid, aluminum support panel;

a second, substantially-rigid, aluminum support panel, the second support panel having the same shape as the first support panel and being interchangeable with the first support panel;

a hinge physically integrated with the first support panel and the second support panel and pivotally connecting the first support panel to the second support panel such that the first support panel and the second support panel are moveable between a flat configuration and a folded configuration, the first support panel and the second support panel cooperating to form a substantially continuous and substantially planar writing-support surface when in the flat configuration; and a clip connected to the first support panel and configured to selectively hold papers.

4. A foldable clipboard, comprising:

a first piece including a first writing surface, a first top hinge surface continuous with the first writing surface, and a first bottom hinge surface continuous with the first writing surface;

a clip connected to the first writing surface and configured to selectively hold papers;

a second piece including a second writing surface, a second top hinge surface continuous with the second writing surface, and a second bottom hinge surface continuous with the second writing surface;

a first hinge-connector pivotally connecting the first top hinge surface to the second top hinge surface; and a second hinge-connector pivotally connecting the first bottom hinge surface to the second bottom hinge surface;

wherein the first writing surface and the second writing surface are moveable between a flat configuration and a folded configuration, the first writing surface and the second writing surface cooperating to form a substantially continuous and substantially planar combined writing surface when in the flat configuration.

5. The foldable clipboard of claim 4, wherein the first piece and the second piece are aluminum pieces.

6. The foldable clipboard of claim 5, wherein the first top hinge surface partially defines a top interior edge of the first writing surface and the first bottom hinge surface partially defines a bottom interior edge of the first writing surface.

7. The foldable clipboard of claim 4, wherein the first top hinge surface and the first bottom hinge surface are substantially perpendicular to the first writing surface, and the second top hinge surface and the second bottom hinge surface are substantially perpendicular to the second writing surface.

8. The foldable clipboard of claim 4, wherein the first piece and the second piece are substantially identically shaped and interchangeable.

9. The foldable clipboard of claim 4, wherein the first top hinge surface and the first bottom hinge surface are positioned on a same side relative to the second top hinge surface and the second bottom hinge surface.

10. The foldable clipboard of claim 4, wherein the foldable clipboard is hinged to fold lengthwise along its longitudinal axis.

11. The foldable clipboard of claim 4, wherein the foldable clipboard is hinged to fold widthwise along its latitudinal axis.

12. The foldable clipboard of claim 4, wherein the first writing surface is spaced away from the second writing surface when the foldable clipboard is in the folded configuration so as to accommodate the clip.

13. The foldable clipboard of claim 1, wherein a first piece of aluminum forms the first support panel; and a second piece of aluminum forms the second support panel.

14. The foldable clipboard of claim 13, wherein the first support panel and the second support panel are substantially identically shaped and interchangeable.

15. The foldable clipboard of claim 1, wherein a first piece of plastic forms the first support panel; and a second piece of plastic forms the second support panel.

16. The foldable clipboard of claim 15, wherein the first support panel and the second support panel are substantially identically shaped and interchangeable.

17. The foldable clipboard of claim 1, wherein the hinge spaces the first support panel away from the second support panel when in the folded configuration such that the first support panel and the second support panel are substantially parallel and the clip is between the first support panel and the second support panel.

18. The foldable clipboard of claim 1, wherein the foldable clipboard is hinged to fold lengthwise along its longitudinal axis.

19. The foldable clipboard of claim 1, wherein the foldable clipboard is hinged to fold widthwise along its latitudinal axis.

* * * * *